US006059898A

United States Patent [19]

Fisher et al.

[11] Patent Number: 6,059,898

[45] Date of Patent: May 9, 2000

[54] INDUCTION HARDENING OF HEAT TREATED GEAR TEETH

[75] Inventors: James Steven Fisher, Huntertown; Roland Clark Smith, Milford, both of Ind.

[73] Assignee: Dana Corporation, Toledo, Ohio

[21] Appl. No.: 09/071,259

[22] Filed: May 1, 1998

[51] Int. Cl.[7] ..... C23C 8/22; C22C 38/00

[52] U.S. Cl. ..... 148/319; 148/902

[58] Field of Search ..... 148/319, 902

[56] References Cited

U.S. PATENT DOCUMENTS

| | | | |
|---|---|---|---|
| 2,167,798 | 8/1939 | Denneen et al. | 266/5 |
| 3,357,869 | 12/1967 | Shepeljakovsky | 148/16.5 |
| 3,885,996 | 5/1975 | Abe | 148/12.1 |
| 3,891,474 | 6/1975 | Grange | 148/31.5 |
| 4,173,501 | 11/1979 | Hildebrandt et al. | 148/224 |
| 4,639,279 | 1/1987 | Chatterjee | 148/147 |

*Primary Examiner*—Deborah Yee
*Attorney, Agent, or Firm*—Oldham & Oldham Co., L.P.A.

[57] ABSTRACT

Induction hardening of heat treated gear teeth which includes the steps of rough and finish cutting the gear teeth, or alternatively cutting the gear teeth to their final configuration utilizing a one cut method, carburizing the gear and in particular, the gear teeth, slow cooling, or alternatively drawing back the gear so the gear teeth are not hard, and induction hardening the gear teeth heating only the surface of the gear teeth. This results in improved strength for the gear teeth as a result of increased residual compressive stresses therein. Induction heating of only the surface of the gear teeth results in an relatively low case depth in the root of the gear teeth. Since the residual compressive stresses increase as the case depth decreases, the fatigue life of such a gear will be improved as compared to gears produced using known prior art methods which utilize the case depth from the carburizing process which results in a relatively deeper case and, therefore, lower residual compressive stresses in the gear teeth and a less than desirable fatigue life.

8 Claims, 1 Drawing Sheet

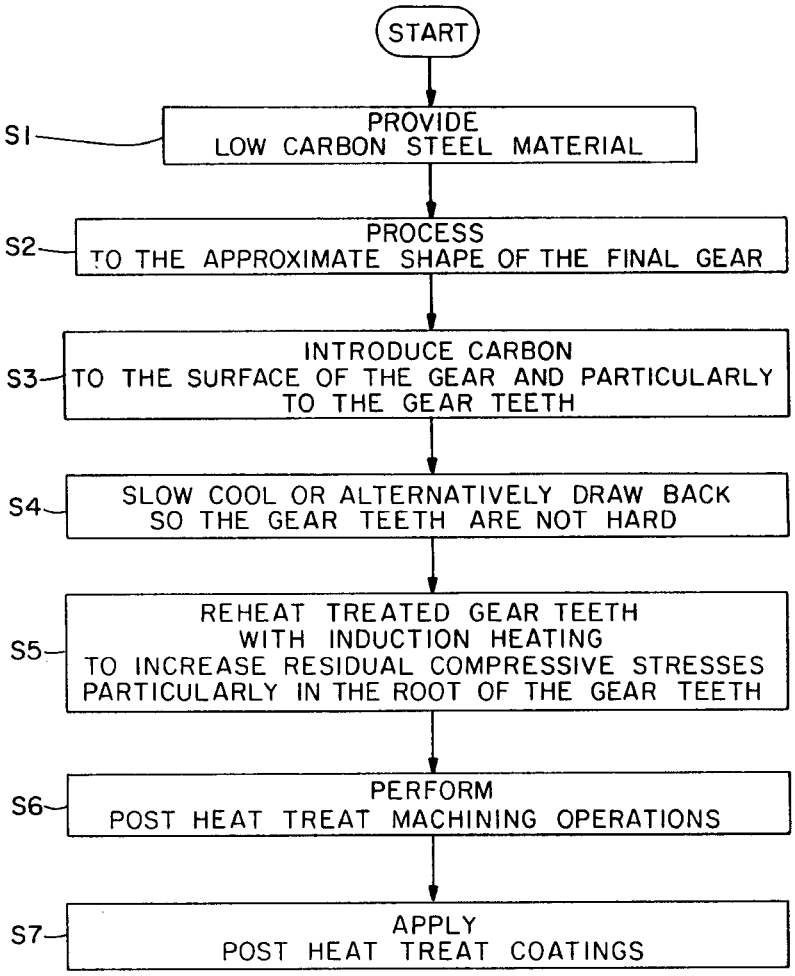

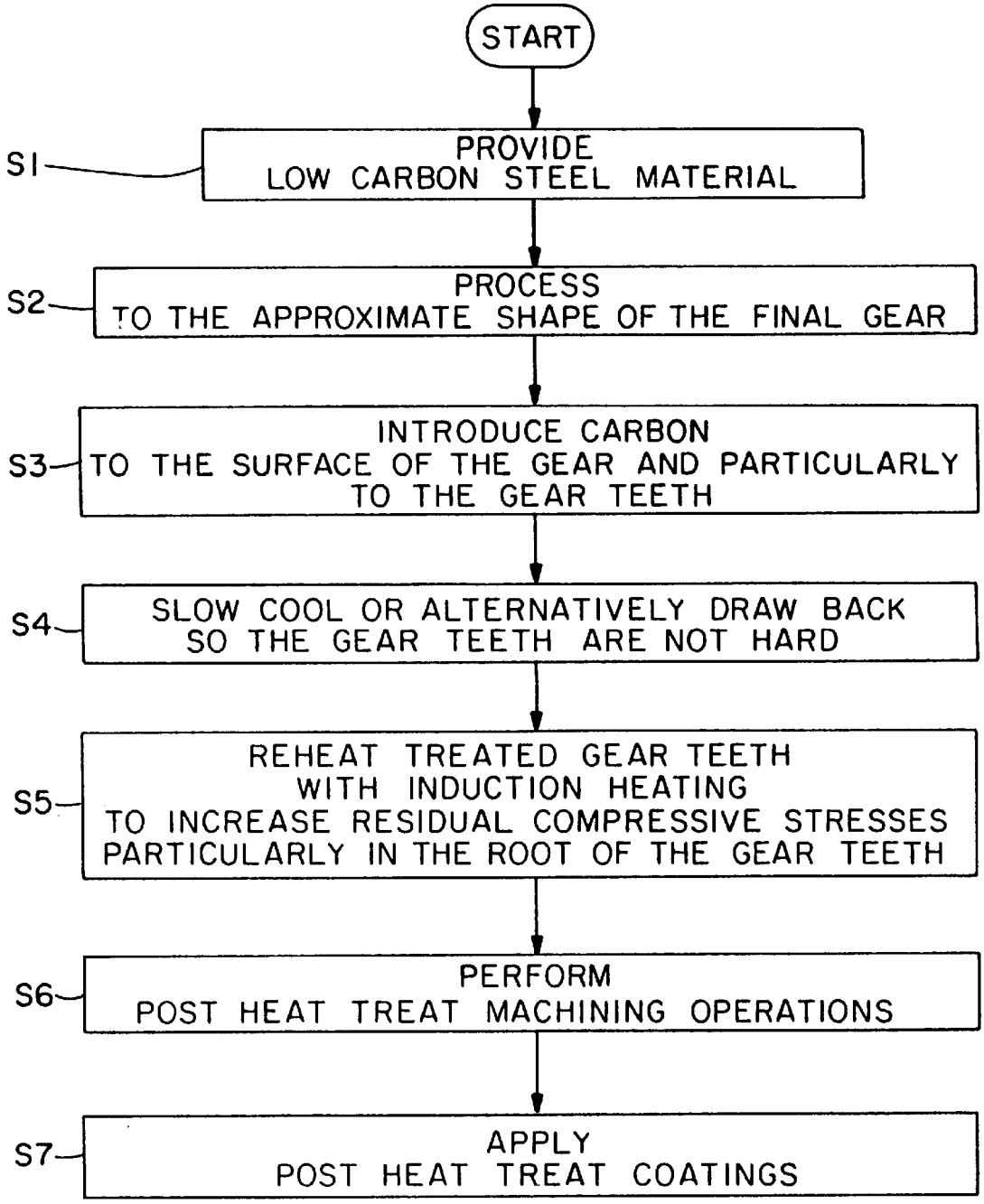
START
S1
PROVIDE
LOW CARBON STEEL MATERIAL
S2
PROCESS
TO THE APPROXIMATE SHAPE OF THE FINAL GEAR
S3
INTRODUCE CARBON
TO THE SURFACE OF THE GEAR AND PARTICULARLY
TO THE GEAR TEETH
S4
SLOW COOL OR ALTERNATIVELY DRAW BACK
SO THE GEAR TEETH ARE NOT HARD
S5
REHEAT TREATED GEAR TEETH
WITH INDUCTION HEATING
TO INCREASE RESIDUAL COMPRESSIVE STRESSES
PARTICULARLY IN THE ROOT OF THE GEAR TEETH
S6
PERFORM
POST HEAT TREAT MACHINING OPERATIONS
S7
APPLY
POST HEAT TREAT COATINGS

INDUCTION HARDENING OF HEAT TREATED GEAR TEETH

BACKGROUND AND SUMMARY OF THE INVENTION

The present invention relates generally to a new and novel method of induction hardening heat treated gear teeth. More particularly, the present invention relates to a new and novel method of induction hardening heat treated gear teeth which provides a final gear having both a tough ductile core, as well as high residual compressive stresses in the root of the gear teeth.

In the field of gear manufacturing, it has long been desirable to produce a gear which has a tough ductile core, while at the same time having high residual compressive stresses present in the root of the gear teeth. One known prior attempt to fabricate such a gear includes the steps of rough cutting the gear teeth, carburizing, but not hardening the gear teeth, finish cutting the gear teeth and then induction hardening the entire gear tooth. While finish cutting the gear teeth after carburizing may result in a gear having improved dimensional characteristics, the cost of such a gear would be prohibitive.

A preferred embodiment of the present invention is, therefore, directed to induction hardening of heat treated gear teeth which includes the steps of rough and finish cutting the gear teeth, or alternatively cutting the gear teeth to their final configuration utilizing a one cut method, carburizing the gear and in particular, the gear teeth, slow cooling, or alternatively drawing back, the gear so the gear teeth are not hard and induction hardening the gear teeth heating only the surface of the gear teeth. This results in improved strength for the gear teeth as a result of increased residual compressive stresses therein. Induction heating of only the surface of the gear teeth results in a relatively shallow case depth in the root of the gear teeth. Since the residual compressive stresses increase as the case depth decreases, the fatigue life of such a gear will be improved as compared to gears produced using known prior art methods which utilize the case depth from the carburizing process which results in a relatively deeper case and, therefore, lower residual compressive stresses in the gear teeth and a less than desirable fatigue life.

Other advantages and novel features of the present invention will become apparent in the following detailed description of the invention when considered in conjunction with the accompanying drawing.

BRIEF DESCRIPTION OF THE DRAWING

The single FIGURE is a flow chart showing the steps of induction hardening heat treated gear teeth in accordance with a preferred embodiment of the present invention.

DETAILED DESCRIPTION OF THE DRAWING

In the following detailed description of a preferred embodiment of the present invention, reference is made to the accompanying drawing which, in conjunction with this detailed description, illustrate and describe a preferred embodiment of induction hardening of heat treated gear teeth in accordance with the present invention. Referring now to the drawing, which illustrates a flow chart showing the steps of induction hardening heat treated gear teeth in accordance with a preferred embodiment of the present invention, gears in accordance with the preferred embodiment of the present invention described herein are preferably fabricated from a low carbon steel material, most preferably a low carbon steel material having a carbon content of 0.35% or less, such as SAE 8620, which is readily forged and machined (S1).

In accordance with the present invention, low carbon steel bar stock is machined, forged or otherwise processed to the approximate shape of the final gear (S2) and can be fabricated to the approximate shape of the final gear with or without gear teeth. If necessary and/or desirable, a heat treating process, such as annealing or normalizing, may be utilized prior to machining the gear to relieve stresses therein and make the gear easier to machine. In one preferred method of fabricating a gear having a plurality of gear teeth, the step of machining, forging or otherwise processing the low carbon steel bar stock to the approximate shape of the final gear (S2) includes the step of rough cutting the gear teeth and then finish cutting the gear teeth followed by heat treating the gear. Alternatively, the step of machining, forging or otherwise processing the low carbon steel bar stock to the approximate shape of the final gear (S2) can include the step of cutting the gear teeth in a single machining operation and then heat treating the gear.

Carbon is then introduced to the surface of the gear, and in particular, the gear teeth, with a conventional heat treating method, such as carburizing or carbonitriding (S3) to raise the carbon content on the surface of the gear, and in particular, the gear teeth to 0.45% or greater and to toughen the core of the gear. The gear is then slow cooled, or alternatively drawn back, so the gear teeth are not hard (S4). While air cooling would generally provide a gear which would be too soft, and thus lack sufficient strength, the gear can be slow cooled, or alternatively drawn back, by regulating and gradually reducing the temperature in a furnace having an inert atmosphere to preclude oxidation. More preferably, the gear can be cooled in a hot oil quench to achieve the desired properties. For example, when cooling a gear from a furnace temperature of approximately 1,600° F. to 1,800° F., an oil bath having a temperature in the range of 250° F. to 850° F. has been found to provide the desired properties. Factors having an impact on the hot oil quench include the temperature of the oil, the thermal characteristics of the particular quench oil selected and the extent of agitation, if any, of the oil bath. These factors can be adjusted and controlled to provide the desired balance of material properties such as strength and ductility in the gear. In general, a more rapid quench will provide a gear which is harder and thus has greater strength and less ductility while a more gradual quench will provide a gear which is softer and thus has less strength and greater ductility.

The gear teeth are then reheat treated with induction heating to increase the residual compressive stresses, particularly in the root of the gear teeth (S5). This results in a gear having gear teeth which are stronger than gears fabricated using other known prior art gear fabricating methods. Post heat treat machining operations (S6), including finishing operations such as hard turning, grinding and lapping can be performed, if desired, on the gear following the induction heating operation. Such finishing operations are beneficial to accommodate for any distortion which may have occurred during previous operations and to provide a gear having an accurate dimensional configuration. However, such finishing operations would preferably not include finish machining of the gear teeth. In addition, if desired, post heat treat material coatings (S7) can be applied to the gear, including, for example, anti-score and/or rust inhibiting coatings.

Known prior art gear fabricating methods typically use surface heat treating methods, such as carburizing, with low carbon steels, such as SAE 8620, or induction heat treating methods with higher carbon steels, such as SAE 1050 or 8650. Currently, when stronger gears are necessary and/or desirable than are achieved utilizing these prior art manufacturing methods, more expensive special steel alloys, such as SAE 9310, are often utilized. These types of special steel alloys are difficult to machine and often have high and unpredictable distortion from the heat treating processes. Accordingly, the cost of gears fabricated from such special steel alloys are generally more expensive than would be desirable, due to both the increased cost of the raw material, as well as increased costs due to slower machining cycles and shortened cutter life.

Another common prior art method used to increase gear strength is to shot peen the area of the gear teeth. While this process does introduce some residual compressive stresses into the area at the root of the gear teeth, it does not introduce as much residual compressive stresses as the induction hardening of heat treated gear teeth in accordance with the preferred embodiment of the present invention described herein. Furthermore, shot peening can distort the gear teeth so the contact pattern of the final gear is not as desired. In addition, extremely hard shot peening of the gear teeth can cause small cracks to form at the tips of the gear teeth due to metal flow from the gear teeth tips which is initiated by the action of the hard shot peening process.

Thus, gears fabricated using the induction hardening of heat treated gear teeth in accordance with the present invention described herein have gear teeth with increased strength due to the high residual compressive stresses present in the root of each gear tooth. For example, typical residual compressive stresses from a conventional carburizing process would generally be approximately 45,000 pounds per square inch (psi). Traditional controlled shot peening of the gear teeth can increase residual compressive stresses to approximately 65,000 to 85,000 pounds per square inch (psi). While higher valves of residual compressive stresses can be achieved through shot peening operations, drawbacks to such aggressive shot peening operations can include excessive distortion, rolled over edges and cracking. Gears fabricated using the induction hardening of heat treated gear teeth in accordance with the preferred embodiment described herein can increase residual compressive stresses to 100,000 pounds per square inch (psi) or more.

Higher levels of residual compresses stresses in the gear teeth are generally desirable because as a load is applied to a gear tooth, the root of the gear tooth is put under a tensile load. When this tensile load is sufficiently high, the gear tooth will begin to permanently yield or crack. To prevent a gear from failing in such circumstances, in the past manufacturers have used special steel alloys that can withstand higher tensile loads, but which are generally more expensive and more difficult to machine as discussed above, or use special processing methods, such as shot peening, with the associated disadvantages discussed above.

However, if even higher gear strength is desired, special steel alloys and/or shot peening can be used in conjunction with the induction hardening of heat treated gear teeth in accordance with the preferred embodiment of the invention described herein to fabricate even stronger gears. Since under high loads the higher residual compressive stresses are first relieved, the higher tensile loads that the special steel alloys can withstand can combine with the increased level of residual compressive stresses in the roots of the gear teeth to produce a gear having even greater strength.

Gears which are fabricated using the induction process alone are generally fabricated from a steel having a higher carbon content, such as SAE 8650, since it is the carbon in the gear that causes the gear to harden. However, higher carbon steels are generally more difficult to process and higher temperatures may be required to forge the gears. This generally results in decreased die life. In addition, high carbon steels tend to harden as they are formed and repeated heat treating to soften the gears between fabricating steps increases the processing cost.

Furthermore, the complex geometry of a gear tooth is difficult to evenly heat with induction heating and the gear tips may become overheated. This may cause the gear tips to harden more deeply than desirable and may result in the gear tips being susceptible to breaking off. In addition, the roots of the gear teeth may not get hot enough for proper hardening and/or the core of the gear teeth may not harden at all. This would result in a weak gear. If the gear blank is heated before machining, such as by a quench and temper process, the hardened gear would be more difficult and expensive to machine.

With gears fabricated utilizing the induction hardening of heat treated gear teeth in accordance with the preferred embodiment of the present invention described herein, the conventional heat treating process, such as carburizing, hardens the core to approximately Rockwell C 20 to 45 which results in a gear which is sufficiently tough without being brittle. This conventional heat treating process also diffuses carbon into the surface of the gear teeth to a depth of approximately 0.045 inches. Depending on the application, the depth of the carbon "case" could be made deeper or more shallow as desired. Since the carbon on the tips of the gear teeth is only approximately 0.045 inches thick, the gear tips are not through hardened as is generally the case with gear tips produced using induction heating alone.

The induction heating process is used to heat the root of the gear teeth and leave a shallow hard (approximately Rockwell C 60) case. It is this shallow case depth that causes the residual compressive stresses to increase. As the case depth becomes even shallower at the ends of the gear teeth, sometimes leaving almost no case at the ends in the gear teeth root, the residual compressive stresses become even higher. This results in a gear having a tough durable core and high residual compressive stresses in the root of the gear teeth. Gears which can be fabricated utilizing the induction hardening of heat treated gear teeth in accordance with the present invention described herein include bevel gears, such as straight bevel gears, spiral bevel gears, hypoid gears and others.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A bevel gear fabricated from a low carbon steel material having a carbon content of less than 0.35%, the bevel gear having a plurality of gear teeth, the bevel gear comprising a core having a hardness of approximately Rockwell C 20 to 45 and diffused carbon on the surface of the gear teeth to a depth of approximately 0.045 inches.

2. The bevel gear in accordance with claim 1, wherein the surface of the gear teeth have a hardness of approximately Rockwell C 60.

3. The bevel gear in accordance with claim 2, wherein the gear teeth have residual compressive stresses 100,000 pounds per square inch (psi) or more.

4. The bevel gear in accordance with claim 1, wherein the gear teeth have residual compressive stresses of 100,000 pounds per square inch (psi) or more.

5. The bevel gear in accordance with claim 1, wherein the bevel gear is a straight bevel gear.

6. The bevel gear in accordance with claim 1, wherein the bevel gear is a spiral bevel gear.

7. The bevel gear in accordance with claim 1, wherein the bevel gear is a hypoid gear.

8. The bevel gear in accordance with claim 1, wherein the surface of the gear teeth has a carbon content in excess of 0.45%.

* * * * *